United States Patent [19]

Devine

[11] Patent Number: 4,949,692

[45] Date of Patent: Aug. 21, 1990

[54] AUTOMATIC CONTROL OF A CARBURETOR FUEL SYSTEM

[75] Inventor: John Devine, Tralee, Ireland

[73] Assignee: 501 Tillotson Limited, Tralee, Ireland

[21] Appl. No.: 260,594

[22] Filed: Oct. 21, 1988

[30] Foreign Application Priority Data

Oct. 23, 1987 [IE] Ireland ..... 2864/87

[51] Int. Cl.[5] ..... F02M 7/18

[52] U.S. Cl. ..... 123/440; 123/438; 261/DIG. 68

[58] Field of Search ..... 123/438, 439, 440; 261/35, DIG. 38, DIG. 68, DIG. 74

[56] References Cited

U.S. PATENT DOCUMENTS 4,417,558 11/1983 Osuga et al. ..... 123/440 X
4,578,228 3/1986 Gerhardy ..... 261/DIG. 68
4,709,677 12/1987 Muraji ..... 123/438
4,769,185 9/1988 Nagasaka et al. ..... 261/DIG. 68
4,793,951 12/1988 Scott ..... 261/DIG. 68

*Primary Examiner*—Willis R. Wolfe
*Attorney, Agent, or Firm*—Harness, Dickey & Pierce

[57] ABSTRACT

A diaphragm type carburetor comprising a main body portion defining a venturi having an air intake side and an engine outlet side. The carburetor has a throttle shutter mounted within the venturi between the air intake side and the engine outlet side, and a metering chamber supplies fuel into the venturi via a main discharge port. The main discharge port opens into the venturi on the air intake side of the throttle shutter. A monitoring means (FIG. 3) is provided to monitor an engine parameter and an electrically controlled valve means is provided to adjust the fuel flow through the main discharge port into the venturi. The valve means is responsive to an electrical signal generated by the monitoring means in response to the engine parameter.

6 Claims, 5 Drawing Sheets

AUTOMATIC CONTROL OF A CARBURETOR FUEL SYSTEM

The present invention relates to a system for automatic control of a carburetor fuel system. In particular, the invention relates to automatic control of a diaphragm type carburetor fuel system.

Diaphragm carburetors of the above kind are well known, see for example U.S. Patent Specification 3,494,343 and 4,271,093 and our published European Patent Specification No. 0,253,469.

In FIG. 1 there is shown a cross-sectional diagram of a conventional HS type carburetor which is similar in construction to the HU type carburetor as shown in E.P.A.—0,253,469 and the parts indicated by the reference numerals in FIG. 1 are identified in the following list.

1. Filtering Screen
2. Venturi
3. Pulse Chamber
4. Fuel Chamber
5. Fuel Pump Diaphragm 5A Diaphragm Pump Inlet
5B Diaphragm Pump Outlet Valve 6. Fuel Pump Body
7. Fuel Pump Gasket
8. Fuel Inlet
9. Impulse Channel
10. Throttle Shutter llA Primary Idle Discharge Port
llB Secondary Idle Discharge Port 12. High Speed Mixture. Screw Orifice
13. Idle Mixture Screw
14. Body
15. Metering Chamber
16. Idle Mixture Screw Orifice
17. Diaphragm
18. Atmospheric Chamber
19. Atmospheric Vent
20. Diaphragm Cover
21. Inlet Tension Spring
22. Fulcrum Pin
23. Diaphragm Gasket
24. Inlet Control Lever
25. Inlet Needle
26. High Speed Mixture Screw
27. Choke Shutter
28. Fuel Inlet Supply Channel
29. Main Nozzle Discharge Port
30. Throttle Bore Since such carburetors are well known in the art, a full description of the operation thereof is not considered necessary. Briefly, however, in operation the metering diaphragm 17 is subject to engine vacuum on the metering chamber side 15 and to atmospheric pressure on the vented side 18. This differential pushes the metering diaphragm 17 towards the inlet control lever 24 which thereby pivots about the fulcrum pin 22 against the downward bias of the spring 21 to open the inlet needle 25 constituting a fuel inlet valve to the metering chamber 15. This allows fuel to enter the metering chamber 15 for delivery to the idle and main discharge jets 11 and 29 respectively, from where the fuel enters the mixing passage 2.

Fuel is caused to enter the metering chamber 15 via the fuel inlet needle 25 by the fuel pump diaphragm 5. The pump diaphragm 5 is caused to move to and fro by pressure fluctuations from the engine sump, which acts on the pump diaphragm 5 through the impulse channel 9. This pulsing movement of the pump diaphragm draws fuel into the fuel chamber 4 from which it passes through the inlet needle 25 into the metering chamber 15.

An internal combustion engine (having a carburetor as described above) when used with a chain saw has only two throttle positions—the idle position and the wide open throttle position. In the idle position of the throttle 10, fuel is supplied from the carburetor (FIG. 1) via the idle fuel discharge orifices 11*a*, 11*b*. In the wide open position of the throttle 10, fuel is supplied from the carburetor primarily through the main fuel discharge port 29. The amount of fuel which enters the venturi 2 of the carburetor through the main discharge port 29, is governed by the setting of the high speed mixture screw 26 which adjusts the size of the main orifice 12. The speed (R.P.M.) of an internal combustion engine when driving a chain saw can vary over an approximate range of 4000 R.P.M. when the chain saw is heavily loaded to approximately 14,000 R.P.M. when no load is encountered by the chain saw i.e. free speed.

One disadvantage with the above types of carburetor is that in chain saw Applications the carburetor is limited to one position of the power needle (mixture screw 26), which is usually set for maximum power, or torque, during cutting at 8500/9000 RPM W.0.T. (wide open throttle). However, this setting may not be optimum for other points on the power curve, i.e. the engine may be running richer or leaner than the desired optimum setting. This setting of the power screw 26 must also run the engine at a stable free speed (no load).

Thus, if the high speed mixture screw 26 is set for maximum power during cutting at an engine speed of 8500/9000 RPM (W.0.T.), then if there is no load applied, or if the load is greater so that the engine speed reduces substantially below 8500/9000 RPM, the engine will not be obtaining the correct amount of fuel for optimum efficiency. In particular, when no load is applied to the chain saw the engine will run at a much higher speed with the consequent danger of the engine seizing. Also, as the engine speed is much faster—perhaps up to 14000 RPM, the amount of fuel being supplied may be insufficient resulting in the engine possibly cutting out. One method of alleviating this problem is to adjust the high speed mixture screw 26 to a position which will supply more fuel to the engine and limit its speed under no load. With this position of the mixture screw 26, the engine will be stable at high speed, but during cutting with the chain saw, the engine will be loaded and with its speed at about 8500/9000 RPM, it will be receiving too much fuel and thus running too rich with a consequent drop in power. If the engine is very heavily loaded so that its speed reduces substantially below 8500 RPM, it will be running much too rich and may possible cut out.

One object of the present invention is to provide a construction of diaphragm carburetor incorporating a fuel metering system which is responsive to variations in engine load requirements.

According to the invention there is provided a carburetor comprising a main body portion defining a venturi having an air intake side and an engine outlet side, a throttle shutter mounted within the venturi between the air intake side and the engine outlet side, a metering chamber for supplying fuel into the venturi via a main discharge port and at least one idle discharge port, the main discharge port opening into the venturi on the air intake side of the throttle shutter, characterised in that there is provided means for monitoring an engine parameter, and electrically controlled valve means for adjusting the fuel flow through the main discharge port into the venturi, the valve means being responsive to an electrical signal generated by the monitoring means in response to the engine paratmeter.

The invention further provides an internal combustion engine including a diaphragm carburetor characterised in that there is provided an electrically controlled valve means for adjusting the fuel flow into the carburetor venturi, the valve means being responsive to an electrical signal generated in response to an engine parameter.

An embodiment of the invention will now be described, by way of example, with reference to the accompanying drawings in which.

Figure 2:
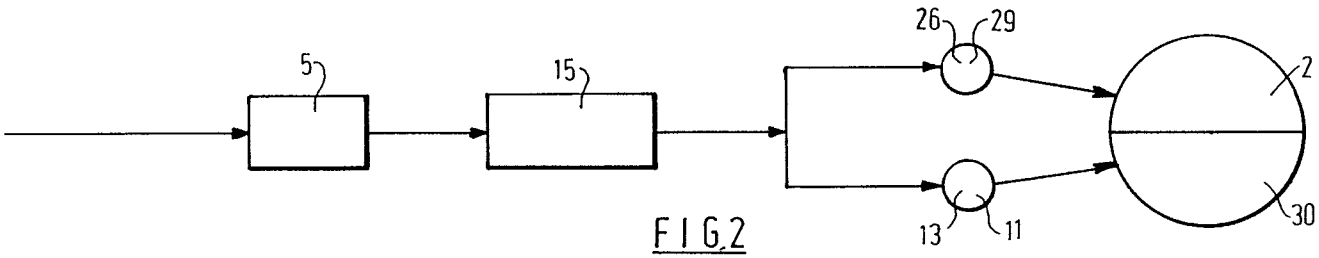
FIG. 2 is a schematic representation of the fuel control system of the carburetor of FIG. 1.

Referring now to FIG. 2 the fuel control system of the conventional HS type carburetor is shown. In this carburetor fuel passes from the fuel pump 5 into the metering chamber 15. The fuel flow through the idle discharge ports 11 is governed by manual adjustment of the idle mixture screw 13. The fuel flow through the main discharge port 29 is governed by manual adjustment of the high speed mixture screw 26.

Figure 3:
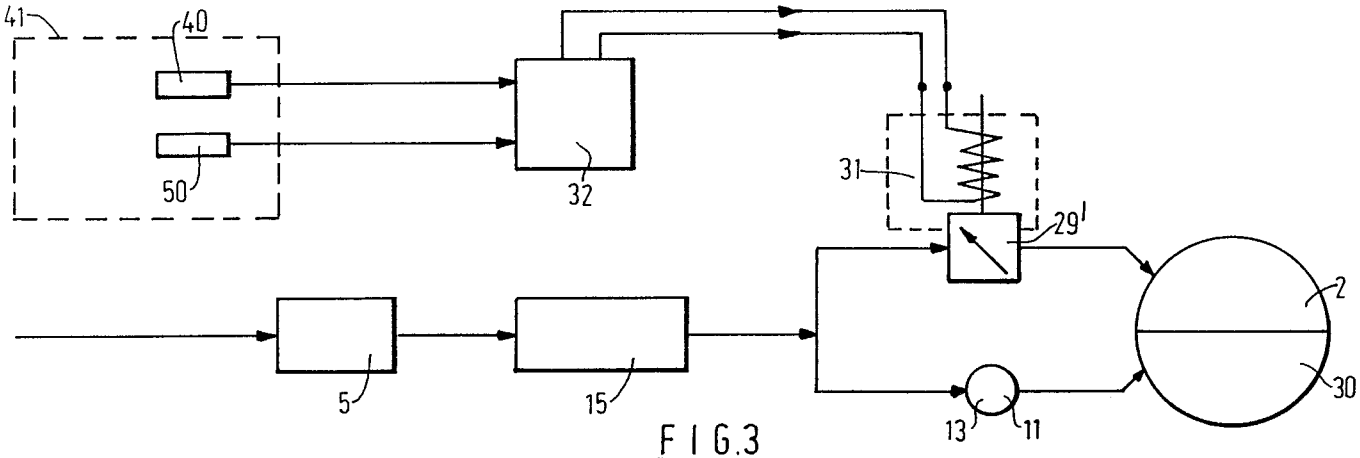
FIG. 3 is a schematic representation of the fuel control system of a carburetor according to the present invention.

In FIG. 3 the arrangement of the present invention is shown and it will be seen that the fuel control through the idle discharge ports 11 is similar to that in FIG. 2. However, the fuel flow through the main discharge port 29′ is now governed by means of an electronic fuel metering valve or an electrical flow controller (EFC) 31. The EFC 31 is controlled by means of an electrical signal from a control circuit 32, the electrical signal output from the control circuit 32 being generated in response to an engine parameter for example engine RPM 40 or engine exhaust gas oxygen content 50.

Figure 8:
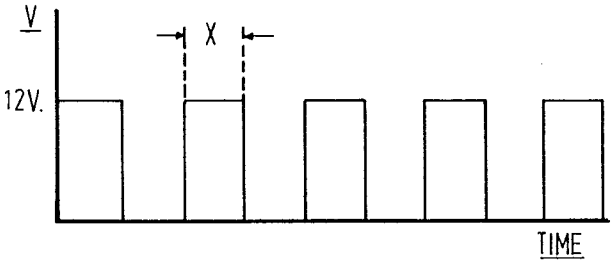
FIG. 8 is a diagram illustrating the electrical signal output of the control circuit of FIG. 4.

A suitable electrical flow controller 31 is manufactured by the Borg Warner Corporation, U.S.A. This EFC 31 effectively operates as a variable orifice which responds to a digital (pulse) form of electrical signal at a fixed frequency. An example of the signal output from the control circuit 32 which is fed to the EFC 31 is shown in FIG. 8. The flow rate of fuel through the EFC 31 is determined by the pulse width X and as the pulse width X increases the flow rate decreases and as the pulse width decreases, the flow rate increases. In the present invention the EFC 31 is selected to operate at a pulse frequency of 40 HZ.

Figure 1:
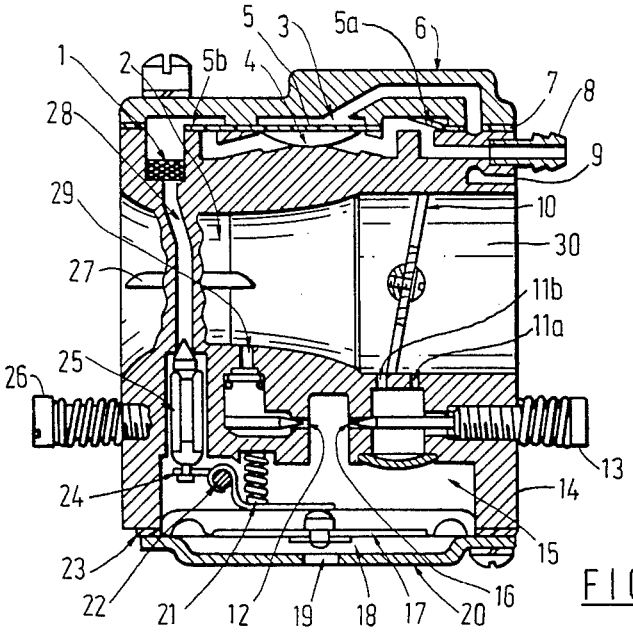
FIG. 1 is a cross-sectional view through a HS type diaphragm carburetor previously described.
Figure 6:
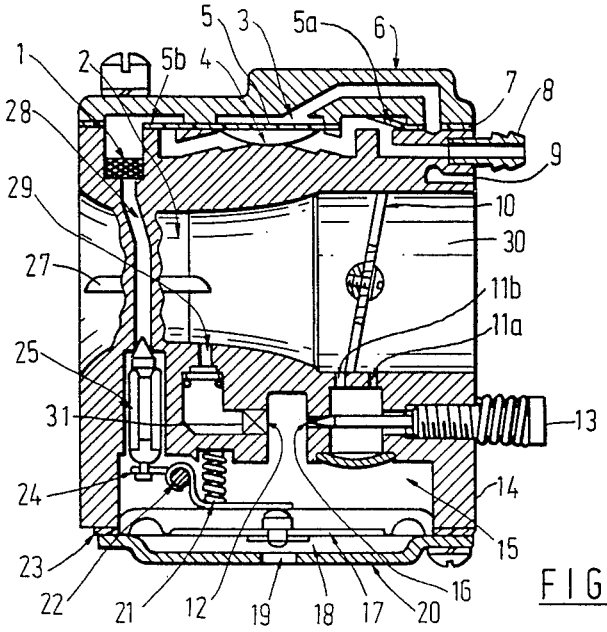
FIG. 6 is a cross-sectional view through one embodiment of a carburetor similar to that of FIG. 1, but incorporating a control valve according to the invention.

In FIG. 6, there is shown one embodiment of a carburetor according to the invention. The carburetor of FIG. 6 is similar to that previously described in relation to FIG. 1, however, the high speed mixture screw 26 has been omitted and the EFC 31 is now fixed in the high speed mixture screw orifice 12. Thus, fuel flow in the carburetor of FIG. 6 between the metering chamber 15 and the main fuel discharge port 29 is governed by operation of the EFC 31.

Figure 4:
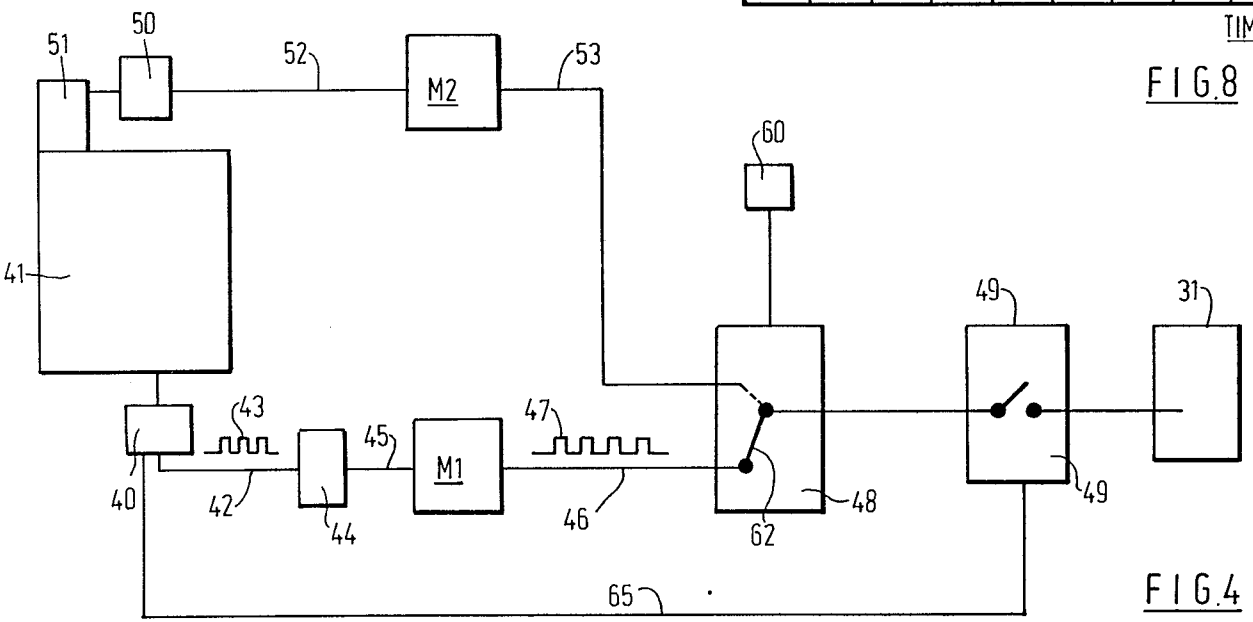
FIG. 4, is a schematic block diagram of the control circuit of FIG. 3.

The operation of the control circuit 32 will now be described in greater detail with reference to FIG. 4. An ignition pulse sensor 40 monitors the ignition pulses in the internal combustion engine 41. The sensor 40 provides at its output 42 a pulse frequency signal 43 corresponding to the ignition pulse rate. It will be understood that the output signal 43 of the sensor 40 provides an indication of the speed (RPM) of the engine 41 (i.e. one ignition pulse corresponds to 1 RPM). The ignition pulse frequency signal 43 is fed to a pulse frequency to DC converter 44 which converts the signal 43 to a voltage signal which is provided at output 45. The voltage signal at the output 45 is then fed to a microprocessor MI, which produces at its output 46 a duty voltage pulse cycle 47 at a frequency of 40HZ. This output signal 47 is fed via two switches 48, 49 (to be described below) to the EFC 31 to control the fuel flow rate, through the EFC. The output signal 47 is therefore similar to that described in relation to FIG. 4, with the pulse width X being determined by the engine fuel requirements.

Figure 5:
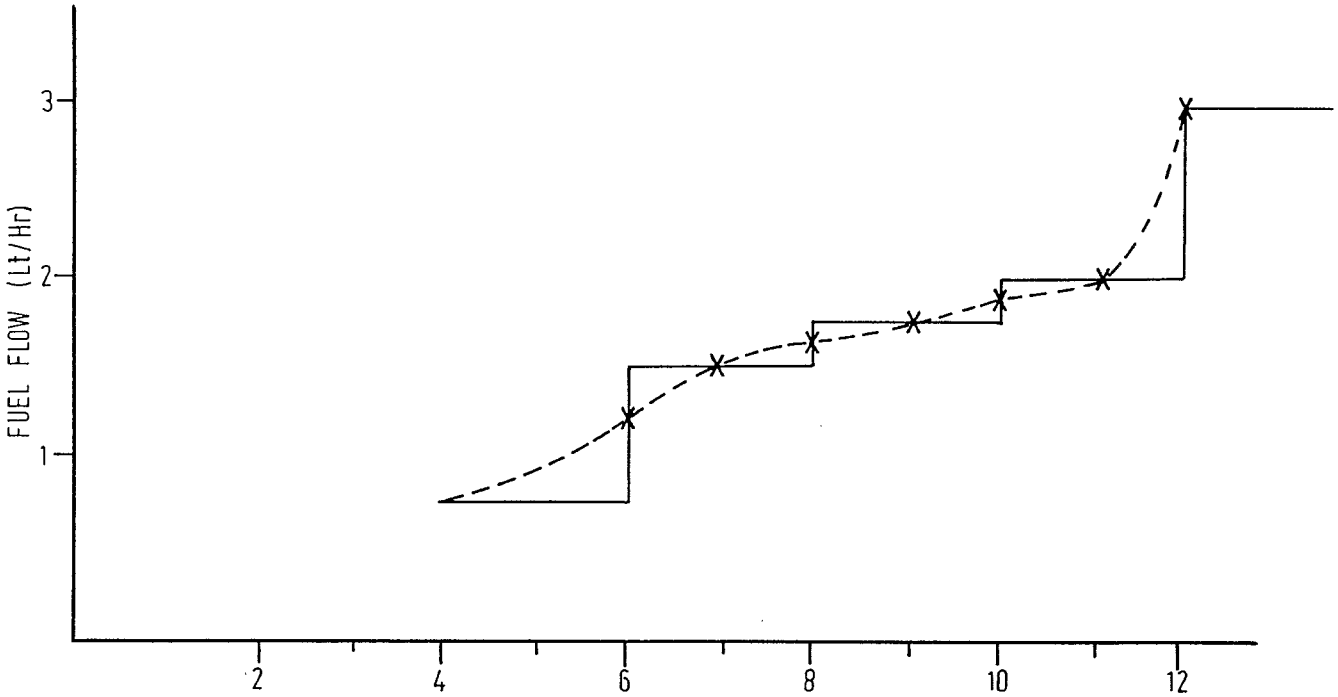
FIG. 5 is a graph showing engine fuel requirement versus engine speed for a typical internal combustion engine.

In FIG. 5 there is shown a graph of fuel flow in liters/hour, versus engine speed (RPM) for a typical internal combustion engine 41 used with a chain saw. The dotted line of the graph which has been obtained from empirical data (by dynometer testing of the engine with the throttle wide open), illustrates the fule requirements of the engine 41 at different engine speeds. Thus, the microprocessor MI which includes a pulse generator (not shown) will provide a signal output 47 dependent upon the speed (RPM) of the engine 41, to obtain the desired fuel flow through the EFC 31, for optimum power of the engine 41. While the microprocessor MI could provide a signal 47 which would enable the fuel flow through the EFC to vary continuously, as shown by the dotted line, in practice it has been found that the stepped signal output 47 is adequate which produces a stepped variation in fuel flow against engine speed (RPM) as shown by the full line of FIG. 5.

This is in effect an open-loop system with the fuel flow through the EFC 31 varying in response to engine speed.

Further, an oxygen sensor 50 is fixed in the exhaust outlet 51 of the engine 41 and monitors the oxygen content of the exhaust gases from the engine. An example of a known type of oxygen sensor is a LAMBDA sensor which is known in the art. The oxygen sensor does not operate below a temperature of approximately 300° C. The oxygen sensor 50 provides a low d.c. voltage signal output 52, of the order of 400MV, the magnitude of this signal depending upon the oxygen content of the gases in the exhaust outlet 51, and thus provides an indication as to whether or not the engine is operating at either too rich or too weak a fuel mixture. The signal output 52 is fed to the input of a microprocessor M2, which also includes a pulse generator (not shown). The microprocessor M2 outputs a duty voltage pulse cycle 53 similar to that in FIG. 4, with the pulse width X determined by whether the engine 41 is operating at too weak, too rich or the optimum fuel/air ratio. The duty pulse cycle 53 is again fed to the EFC 31 via the switches 48, 49 to regulate the fuel flow through the EFC 31 and thus through the main fuel discharge nozzle 29.

If the signal 52 from the oxygen sensor 50 is less than a predetermined value of approximately 400MV, this indicates that the engine 41 is operating at too weak a fuel mixture. Thus, the width X of the duty cycle pulse output 53 of microprocessor M2 decreases to enable the fuel flow through the EFC 31 to increase. Similarily if the signal output 52 from the oxygen sensor 50 is greater than 400MV, this indicates that the engine 41 is operating at too rich a fuel mixture. Thus, the width X of the duty cycle pulse output 53 of microprocessor M2 increases to reduce the fuel flow through the EFC 31.

The switch 48 is provided to enable the output signal 47 or 53 from microprocessors M1, M2 respectively, to be selectively connected to the EFC 31. Since the oxygen sensor 50 only operates at approximately 300° C. and above, it is necessary that the EFC 31 is controlled by the signal from microprocessor Ml until the oxygen sensor 50 reaches this temperature. Thus, switch 48 is operated by a signal from a temperature monitor 60 suitably located on the engine 41 and the arm 62 is connected to microprocessor Ml below a temperature of about 170° C. and is connected to microprocessor M2 at a temperature above approximately 170° C.

Moreover, switch 49 is provided so that when the engine speed is below approximately 3500 RPM, no signal is received by the EFC 31 so that it remains fully open during idling of the engine 41. Thus, switch 49 is closed when a signal 65 from the ignition pulse monitor 40 indicates that the engine speed is greater than 3500 RPM.

In use, the engine 41 drives a chain saw (not shown).

Figure 7:
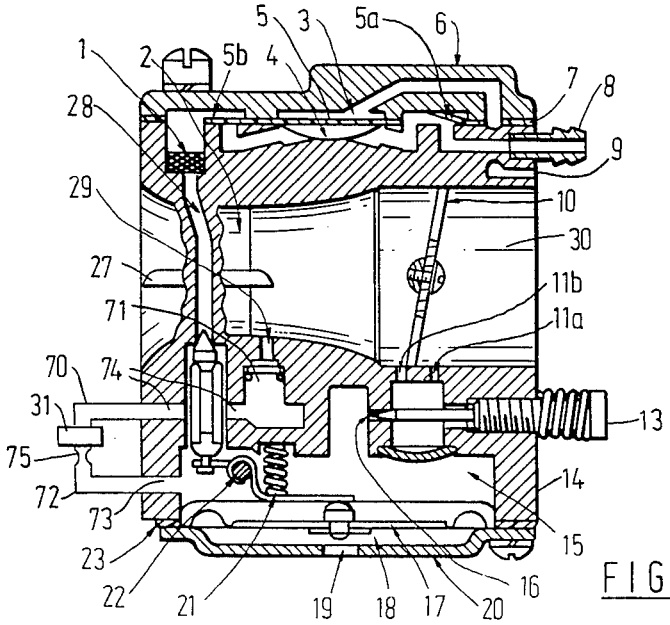
FIG. 7 is a cross-sectional view through a second embodiment of carburetor according to the invention.

In FIG. 7, there is shown another embodiment of a carburetor according to the invention. In this embodiment, the carburetor shown is similar to that previously described in relation to FIG. 1 however, the high speed mixture screw 26 has been omitted and the high speed mixture screw orifice 12 has been blocked as shown. A conduit 70 extends between the metering chamber 15 and the main fuel nozzle chamber 71. The conduit 70 comprises a pipe 72 mounted externally of the carburetor, the pipe 72 communicating with bores 73, 74 in the carburetor body. The electronic flow metering valve (EFC) 31 is mounted in the pipe 72. The pipe 72 also has a restriction 75 as will be described below. Thus, fuel from the metering chamber 15 can flow through bore 73, the pipe 72 and EFC 31, and into the chamber 71 via the bore 74. Fuel which enters the chamber 71 can then discharge into the venturi through the main fuel discharge nozzle 29 as previously described.

The restriction 75 will be of suitable dimensions so as to limit the fuel flow, to the required maximum rate, which will prevent the engine 41 from operating above its maximum speed (RPM). In this embodiment the engine speed monitoring circuit provided by the ignition pulse detector 40 and microprocessor Ml is therefore omitted, and the EFC 31 is only controlled by the oxygen sensor 50. Since the oxygen sensor 50 can only operate above a temperature of approximately 300° C., the restriction 75 is provided to limit the engine 41 free running speed, until the oxygen sensor 50 reaches its operating temperature.

As an example only, the restriction 75 may be of a diameter of 0.03 inches for a 70CC engine, which will provide a fuel flow rate to limit the engine speed to approximately 13000 RPM. In use, the EFC 31 will reduce further the fuel flow rate when the engine speed is reduced under load.

I claim:

1. A diaphragm type carburetor comprising a main body portion defining a venturi having an air intake side and an engine outlet side, a throttle shutter mounted within the venturi between the air intake side and the engine outlet side, a metering chamber for supplying fuel into the venturi via a main discharge port, the main discharge port opening into the venturi on the air intake side of the throttle shutter, wherein there is provided means for monitoring an engine parameter, and electrically controlled valve means for adjusting the fuel flow through the main discharge port into the venturi, the valve means being responsive to an electrical signal generated by the monitoring means in response to the engine parameter, wherein the valve means is mounted in a conduit externally of the carburetor body, the conduit communicating with the metering chamber and the main fuel discharge nozzle.

2. A carburetor as claimed in claim 1 wherein the conduit has a restriction to limit the fuel flow rate to the main fuel discharge nozzle.

3. A diaphragm type carburetor comprising a main body portion defining a venturi having an air intake side and an engine outlet side, a throttle shutter mounted within the venturi between the air intake side and the engine outlet side, a metering chamber for supplying fuel into the venturi via a main discharge port, the main discharge port opening into the venturi on the air intake side of the throttle shutter, wherein there is provided means for monitoring an engine parameter, and electrically controlled valve means for adjusting the fuel flow through the main discharge port into the venturi, the monitoring means comprising a first circuit means for monitoring the ignition pulses of the engine and a second circuit means for monitoring the oxygen content of the engine exhaust gases which circuits provide output signals for adjusting the fuel flow through the man discharge port.

4. A carburetor as claimed in claim 3 wherein the valve means is mounted in the carburetor between the metering chamber and the main fuel discharge nozzle.

5. A carburetor as claimed in claim 3 wherein the output signals from said first and second circuit means are fed to the valve means via a first switch, said first switch being responsive to the engine temperature, so as to connect the first circuit means to the valve means below a predetermined temperature, and connects the second circuit means to the valve means when the engine temperature is at or above the predetermined temperature.

6. A carburetor as claimed in claim 5 wherein the valve means is connected to the output of said first switch via a second switch, said second switch being responsive to the engine speed so as to be open circuit below a predetermined engine speed.

* * * * *